US011484090B2

(12) United States Patent
Chen et al.

(10) Patent No.: US 11,484,090 B2
(45) Date of Patent: Nov. 1, 2022

(54) ARTICLE OF FOOTWEAR WITH BALL CONTROL REGION

(71) Applicant: NIKE, Inc., Beaverton, OR (US)

(72) Inventors: Yuchung K. Chen, Portland, OR (US); Joël Ryp Greenspan, Portland, OR (US); Oliver McLachlan, Beaverton, OR (US); Stuart Reinhardt, Beaverton, OR (US); Thomas J. Rushbrook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 104 days.

(21) Appl. No.: 17/029,744

(22) Filed: Sep. 23, 2020

(65) Prior Publication Data

US 2021/0085018 A1 Mar. 25, 2021

Related U.S. Application Data

(60) Provisional application No. 62/904,802, filed on Sep. 24, 2019.

(51) Int. Cl.
*A43B 5/02* (2006.01)
*A43B 23/02* (2006.01)

(52) U.S. Cl.
CPC ..... *A43B 5/025* (2013.01); *A43B 23/028* (2013.01)

(58) Field of Classification Search
CPC ..... A43B 5/025; A43B 5/02; A43B 23/028
USPC ..... 36/128, 133
See application file for complete search history.

(56) References Cited

U.S. PATENT DOCUMENTS

| | | | | |
|---|---|---|---|---|
| 3,191,321 | A | 6/1965 | Brutting | |
| 3,650,061 | A | 3/1972 | Craft, Jr. | |
| 4,712,317 | A | 12/1987 | Sowell | |
| 5,216,827 | A | 6/1993 | Cohen | |
| 5,437,112 | A | 8/1995 | Johnston | |
| 5,737,858 | A | 4/1998 | Levy | |
| 6,205,682 | B1 * | 3/2001 | Park | A43B 13/20 36/71 |
| 6,523,282 | B1 | 2/2003 | Johnston | |
| 7,487,605 | B2 | 2/2009 | Hatzilias | |
| 7,562,471 | B2 | 7/2009 | Minami | |
| 7,941,943 | B2 | 5/2011 | Baker et al. | |
| 8,042,289 | B2 | 10/2011 | Minami | |
| 8,196,321 | B2 | 6/2012 | Baker et al. | |
| 8,196,322 | B2 | 6/2012 | Atsumi et al. | |
| 8,356,429 | B2 | 1/2013 | Eder et al. | |

(Continued)

FOREIGN PATENT DOCUMENTS

| | | | |
|---|---|---|---|
| GB | 2085279 | A | 4/1982 |
| GB | 2248171 | A | 4/1992 |

(Continued)

OTHER PUBLICATIONS

European Patent Office (ISA), International Search Report and Written Opinion for PCT Application No. PCT/US2020/052356, dated Dec. 3, 2020.

*Primary Examiner* — Marie D Bays
(74) *Attorney, Agent, or Firm* — Bookoff McAndrews, PLLC

(57) ABSTRACT

An article of footwear includes an upper and a ball control region. The ball control region is formed on an exterior surface of the upper and includes at least one ball control pad having a ball control panel attached to and spaced apart from the upper by one or more flexible elements.

20 Claims, 5 Drawing Sheets

(56) References Cited

U.S. PATENT DOCUMENTS

| | | | | |
|---|---|---|---|---|
| 8,484,865 | B2 | 7/2013 | Baker et al. | |
| 8,631,590 | B2 | 1/2014 | Droege et al. | |
| 8,789,298 | B2 | 7/2014 | Eder et al. | |
| 8,844,171 | B2 | 9/2014 | Eder et al. | |
| 8,914,997 | B2 | 12/2014 | Adami et al. | |
| 8,943,711 | B2 | 2/2015 | Hooper et al. | |
| 8,950,087 | B2 | 2/2015 | Baucom et al. | |
| 9,009,992 | B2 | 4/2015 | Baker et al. | |
| 9,021,720 | B2 * | 5/2015 | Hazenberg | A43B 13/20 36/43 |
| 9,038,288 | B2 | 5/2015 | Droege et al. | |
| 9,179,732 | B2 * | 11/2015 | Minami | A43B 23/028 |
| 9,388,873 | B1 * | 7/2016 | Phipps | F16F 3/04 |
| 9,839,254 | B2 | 12/2017 | Stauffer et al. | |
| D899,035 | S * | 10/2020 | Padilla | D2/902 |
| 2003/0167658 | A1 * | 9/2003 | Davis | A43C 13/14 36/128 |
| 2004/0055183 | A1 | 3/2004 | Lee et al. | |
| 2004/0088888 | A1 | 5/2004 | Johnston | |
| 2009/0113766 | A1 | 5/2009 | Hooper | |
| 2010/0011620 | A1 * | 1/2010 | Nakano | A43B 1/0009 36/35 R |
| 2010/0077637 | A1 | 4/2010 | Hatzilias | |
| 2010/0180469 | A1 * | 7/2010 | Baucom | A43B 3/0031 36/55 |
| 2010/0275463 | A1 | 11/2010 | Gallagher | |
| 2012/0291946 | A1 * | 11/2012 | Turner | A43B 17/14 156/264 |
| 2013/0232815 | A1 * | 9/2013 | Meythaler | A43B 23/0235 428/140 |
| 2013/0312284 | A1 * | 11/2013 | Berend | A43B 23/0245 36/83 |
| 2014/0101816 | A1 * | 4/2014 | Toronjo | A41B 1/08 36/83 |
| 2016/0095480 | A1 | 4/2016 | Wilson et al. | |
| 2016/0227873 | A1 * | 8/2016 | Kirk | A43C 15/162 |
| 2021/0085018 | A1 * | 3/2021 | Chen | A43B 5/025 |
| 2021/0368941 | A1 * | 12/2021 | Chen | A43B 1/0072 |

FOREIGN PATENT DOCUMENTS

| | | | |
|---|---|---|---|
| JP | 2011087916 | A | 5/2011 |
| WO | WO-1996/032856 | A2 | 10/1996 |

* cited by examiner

FIG. 3
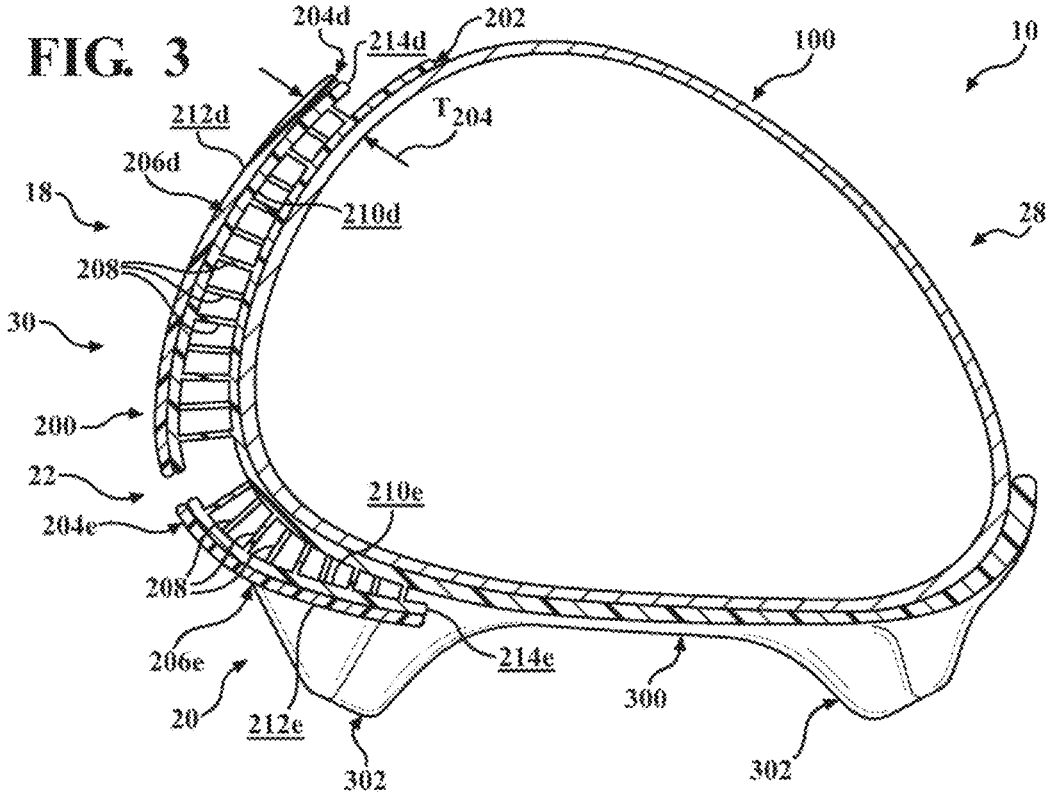
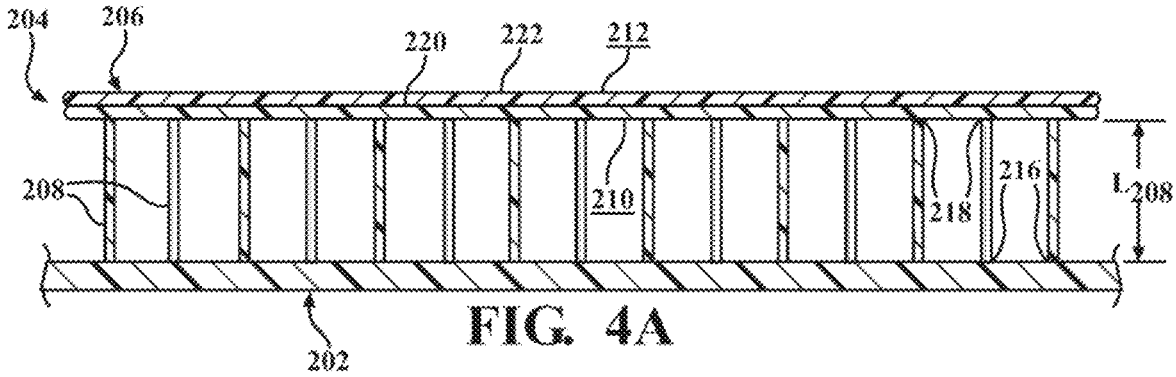
FIG. 4A
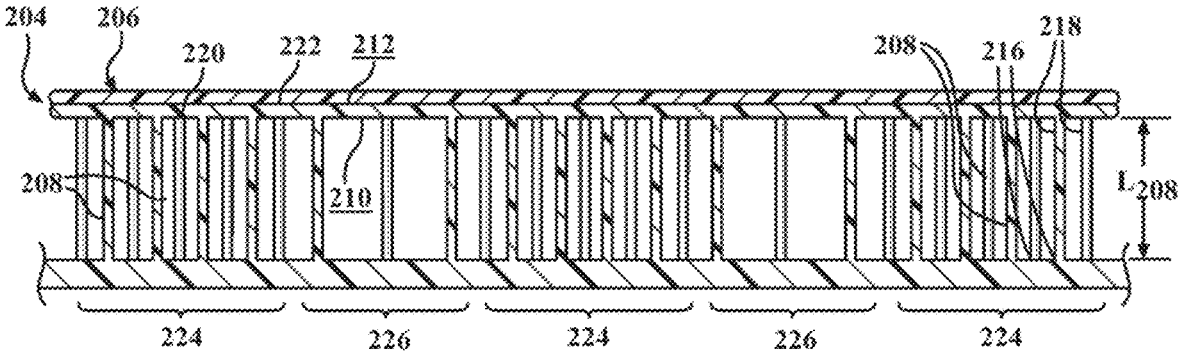
FIG. 4B

ARTICLE OF FOOTWEAR WITH BALL CONTROL REGION

CROSS REFERENCE TO RELATED APPLICATION

This application claims priority under 35 U.S.C. § 119(e) to Provisional U.S. Patent Application No. 62/904,802, filed Sep. 24, 2019, the disclosure of which is hereby incorporated by reference in its entirety.

FIELD

The present disclosure relates generally to articles of footwear, and more particularly, to articles of footwear having ball control regions.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. The outsole may include one or more traction elements or cleats for engaging a ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces.

The upper is attached to the sole structure and is generally designed based on the intended use of the article of footwear. For example, uppers intended for use during running are typically formed from lightweight, flexible, and breathable materials while uppers intended for use during contact sports such as soccer or football are formed from a more rigid material that provides a degree of protection to the athlete. Such uppers may also include sport-specific features that aid an athlete in making particular movements (i.e., cutting movements versus forward movements) and/or making contact with a ball or other object.

DRAWINGS

The drawings described herein are for illustrative purposes only of selected configurations and are not intended to limit the scope of the present disclosure.

FIG. 3 is a cross-sectional view of the article of footwear of FIG. 1, taken along section line 3-3 of FIG. 2;

FIG. 4A is a cross-sectional view of an example of a ball control pad in accordance with principles of the present disclosure;

FIG. 4B is a cross-sectional view of another example of a ball control pad in accordance with principles of the present disclosure;

Corresponding reference numerals indicate corresponding parts throughout the drawings.

DETAILED DESCRIPTION

Figure 1:
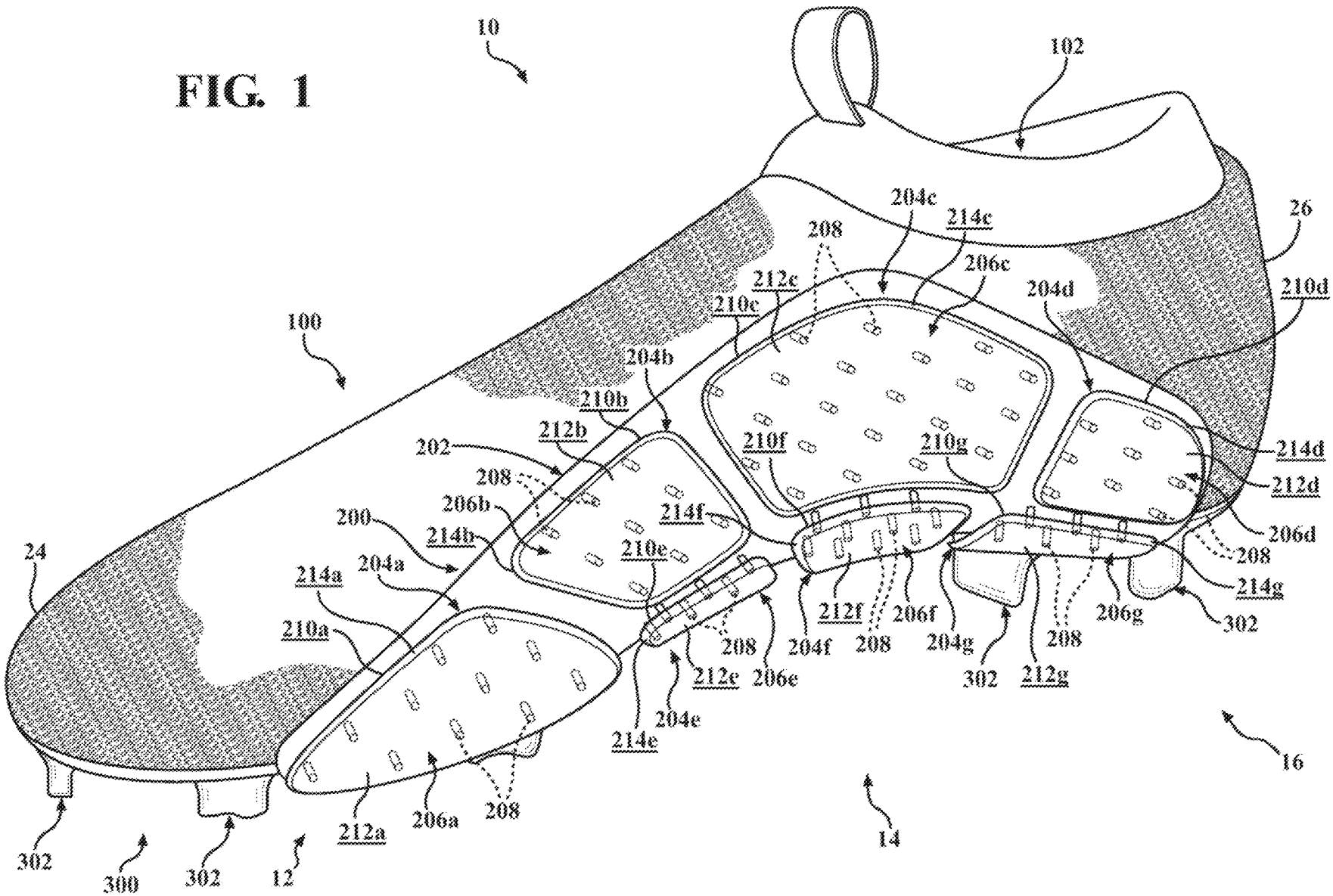
FIG. 1 is a top perspective view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides an article of footwear. The article of footwear includes an upper and a ball control region formed on an exterior surface of the upper. The ball control region includes at least one ball control pad having a ball control panel attached to and spaced apart from the upper by one or more flexible elements.

Implementations of the disclosure may include one or more of the following optional features. In some implementations, the at least one ball control pad includes a first ball control pad attached to a first portion of the upper and a second ball control pad attached to a second portion of the upper independently from the first ball control pad. Each of the one or more flexible elements may be a resilient element having a first end attached to the upper and a second end attached to the ball control panel. The ball control panel may include a first layer formed of a first material and a second layer formed of a second material. Here, the first layer may be attached to the flexible elements and the first material may have a hardness greater than the second material. Optionally, the second layer may form an exterior surface of the ball control panel and the second material may have a coefficient of friction greater than the first material.

In some configurations, the at least one ball control pad includes a first series of ball control pads extending from a toe region to a heel region and a second series of ball control pads extending from a mid-foot region to the heel region. Here, the first series of ball control pads may be disposed above the second series of ball control pads. On some examples, a stiffness of the at least one ball control pad varies from a first portion of the ball control pad to a second portion of the ball control pad. A concentration of the flexible elements of the at least one ball control pad may vary from a first portion of the ball control pad to second portion of the ball control pad. A thickness of the at least one ball control pad may vary from a first portion of the ball control pad to a second portion of the ball control pad. The at least one ball control pad may include a first ball control pad having a first stiffness and a second ball control pad having a second stiffness that is different from the first stiffness.

Another aspect of the disclosure provides an article of footwear. The article of footwear includes an upper and a ball control region formed on an exterior surface of the upper. The ball control region includes a plurality of ball control pads each having a ball control panel spaced apart from and resiliently attached to the exterior surface of the upper.

Implementations of this aspect of the disclosure may include one or more of the following optional features. In some examples, each of the ball control pads is attached to the exterior surface of the upper by a plurality of flexible elements. Here, a first one of the ball control pads may include a first panel attached to the upper by a first plurality of flexible elements and a second one of the ball control pads may include a second panel attached to the upper by a second plurality of flexible elements, the first plurality of flexible elements having a different concentration of flexible elements than the second plurality of flexible elements. Optionally, each of the plurality of the flexible elements may be a resilient element having a first end attached to the upper and a second end attached to the ball control panel.

In some implementations, the ball control panel includes a first layer formed of a first material and a second layer formed of a second material. The first layer may be attached to the upper and the first material may have a hardness greater than the second material. The second layer may form an exterior surface of the ball control panel and the second material may have a coefficient of friction greater than the first material.

In some configurations, the plurality of ball control pads includes a first series of ball control pads extending from a toe region to a heel region and a second series of ball control pads extending from a mid-foot region to the heel region. Here, the first series of ball control pads may be disposed above the second series of ball control pads. In some examples, a first stiffness of a first one of the ball control pads is different from a second stiffness of a second one of the ball control pads. A first thickness of a first one of the ball control pads may be different from a second thickness of a second one of the ball control pads. At least one of the plurality of ball control pads may taper from a first thickness to a second thickness.

Figure 2:
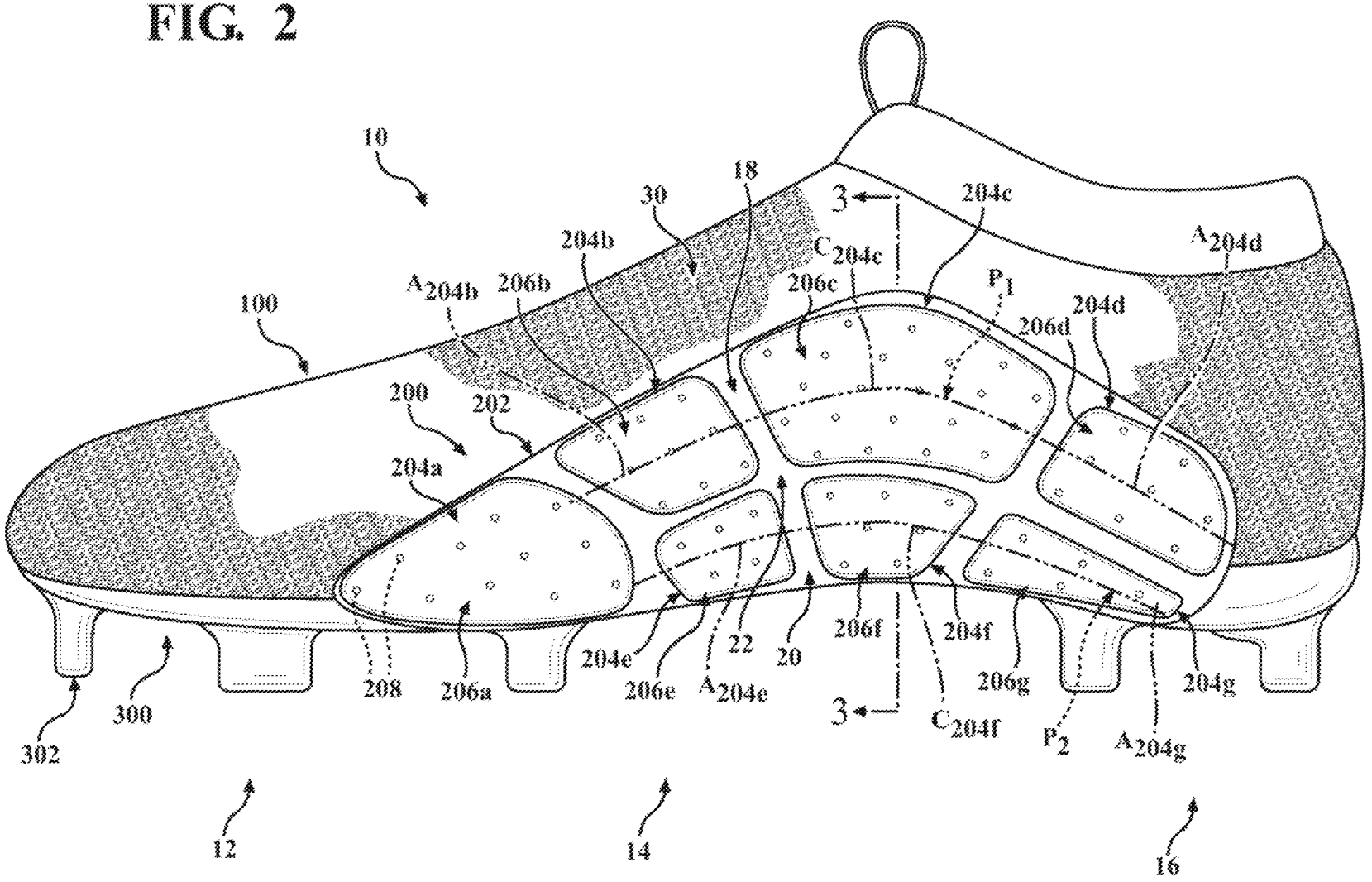
FIG. 2 is a side elevation view of the article of footwear of FIG. 1.

Referring to FIGS. 1 and 2, an article of footwear 10 includes an upper 100 having a ball control region 200, and a sole structure 300 attached to a bottom surface of the upper 100. The article of footwear 10 may be longitudinally divided into one or more regions. The regions may include a forefoot region 12, a mid-foot region 14, and a heel region 16. The forefoot region 12 may be subdivided into a toe portion 12T corresponding with phalanges, and a ball portion 12B associated with metatarsal bones of a foot. The mid-foot region 14 may correspond with an arch area of the foot, and the heel region 16 may correspond with rear portions of the foot, including a calcaneus bone.

As best shown in FIG. 3, the article of footwear 10 also includes vertical regions including a dorsal region 18 associated with the upper portion of the foot and a plantar region 20 associated with the bottom of the foot. A central peripheral region 22 is disposed between the dorsal region 18 and the plantar region 20, and extends around a perimeter of the upper 100.

The footwear 10 may further include an anterior end 24 associated with a forward-most point of the forefoot region 12, and a posterior end 26 corresponding to a rearward-most point of the heel region 16. A longitudinal axis $A_{10}$ of the footwear 10 extends along a length of the footwear 10 from the anterior end 24 to the posterior end 26, parallel to a ground surface. The longitudinal axis $A_{10}$ is centrally located along the length of the footwear 10, and generally divides the footwear 10 into a lateral side 28 and a medial side 30. Accordingly, the lateral side 28 and the medial side 30 respectively correspond with opposite sides of the footwear 10 and extend through the regions 12, 14, 16. As used herein, a longitudinal direction refers to the direction extending from the anterior end 24 to the posterior end 26, while a lateral direction refers to the direction transverse to the longitudinal direction and extending from the lateral side 28 to the medial side 30.

The upper 100 includes interior surfaces that define an interior void 102 configured to receive and secure a foot for support on the sole structure 300. An ankle opening in the heel region 16 may provide access to the interior void 102. For example, the ankle opening may receive a foot to secure the foot within the void 102 and to facilitate entry and removal of the foot from and to the interior void 102. The upper 100 may be formed from one or more materials that are stitched or adhesively bonded together to form the interior void 102. Suitable materials of the upper may include, but are not limited to, mesh, textiles, foam, leather, and synthetic leather. The materials may be selected and located to impart properties of durability, air-permeability, wear-resistance, flexibility, and comfort.

In some examples, the upper 100 includes a strobel (not shown) having a bottom surface opposing the sole structure 300 and an opposing top surface defining a footbed of the interior void 102. The strobel may be attached to the upper 100 using stitching or adhesives. As shown, the upper 100 is formed as a unitary boot or sock, wherein the strobel and the upper 100 are unitarily formed of a knitted material. The footbed defined by the top surface may be contoured to conform to a profile of the bottom surface (e.g., plantar) of the foot. Optionally, the upper 100 may also incorporate additional layers such as one or more support plates, and an insole or sockliner that may be disposed upon the strobel and reside within the interior void 102 of the upper 100 to receive a plantar surface of the foot to enhance the comfort of the article of footwear 10.

In some examples, one or more fasteners extend along the upper 100 to adjust a fit of the interior void 102 around the foot and to accommodate entry and removal of the foot therefrom. The upper 100 may include apertures, such as eyelets and/or other engagement features such as fabric or mesh loops that receive the fasteners. The fasteners may include laces, straps, cords, hook-and-loop, or any other suitable type of fastener. The upper 100 may include a tongue portion that extends between the interior void 102 and the fasteners.

With continued reference to FIG. 1, the upper 100 includes a ball control region 200 formed on the medial side 30 of the upper 100 and extending from the forefoot region 12 to the heel region 16, and from the dorsal region 18 to the plantar region 20. Optionally, the ball control region 200 may be formed in any one or more of the regions 12, 14, 16, 18, 20, 22. For example, the ball control region 200 may be formed only in the forefoot region 12, or may be fragmentarily formed to include a first portion in the forefoot region 12 and a separate second portion in mid-foot region and/or the heel region 16. Likewise, the ball control region 200 may be isolated to the dorsal region 18 or the plantar region 20.

The illustrated example of the ball control region 200 includes a base panel 202 extending along an entire length of the ball control region 200, and one or more ball control pads 204*a*-204*g* disposed on the base panel 202. Generally, each of the ball control pads 204*a*-204*g* is formed as a resilient member having an exterior surface that is compressible and translatable relative to the upper 100. Thus, while the base panel 202 may be fixed relative to the upper 100, the exterior surfaces of the ball control pads 204*a*-204*g* can move relative to and independently of the upper 100. As shown, the one or more ball control pads 204*a*-204*g* includes a plurality of ball control pads 204*a*-204*g* spaced apart from each other along the ball control region 200. Particularly, each of the ball control pads 204*a*-204*g* is independently attached to the base panel 202 such that the exterior surfaces of the ball control pads 204*a*-204*g* can move independently from each other.

In the illustrated configuration, the ball control pads 204*a*-204*g* may be described as including a first ball control pad 204*a* disposed on the medial side 30 of the upper 100 in the forefoot region 12. Particularly, the first ball control pad 204*a* is disposed in a portion of the forefoot region 12 associated with a metatarsophalangeal (MTP) joint of the foot and extends vertically from the dorsal region 18 to the plantar region 20.

Beyond the first ball control pad 204*a*, the ball control region 200 includes an upper, first series of ball control pads 204*b*-204*d* extending along the dorsal region 18 from the forefoot region 12 to the heel region 16. The ball control region 200 further includes a lower, second series of ball control pads 204*e*-204*g* extending along the plantar region 20 from the forefoot region 12 to the heel region 16. As best shown in FIG. 2, the upper series of ball control pads 204*b*-204*d* is vertically spaced apart from the lower series of ball control pads 204*e*-204*g* along the central region 22 such that the base panel 202 is exposed between adjacent pads 204*a*-204*g*.

Each of the upper series of ball control pads 204*b*-204*d* and the lower series of ball control pads 204*e*-204*g* includes a plurality of the ball control pads 204*b*-204*g* arranged along a substantially continuous path, and includes a forefoot ball control pad 204*b*, 204*e*, a mid-foot ball control pad 204*c*, 204*f*, and a heel ball control pad 204*d*, 204*g*. As shown, the upper series of ball control pads 204*b*-204*d* extends along a first arcuate path $P_1$ and the lower series of ball control pads 204*e*-204*g* extends along a second arcuate path $P_2$ that is substantially parallel to the first path $P_1$.

With reference to FIG. 1, the upper series of ball control pads 204*b*-204*d* extends along the first path $P_1$ from the forefoot region 12 to the heel region 16. The upper forefoot ball control pad 204*b* and the upper heel ball control pad 204*d* are substantially straight. Accordingly, the upper forefoot ball control pad 204*b* defines an upper forefoot axis $A_{204b}$ extending in a first longitudinal direction and the upper heel ball control pad 204*d* defines an upper heel axis $A_{204d}$ extending in a second longitudinal direction transverse to the first longitudinal direction. The upper mid-foot ball control pad 204*c* may itself be angled or arcuate to provide a transition between the upper forefoot ball control pad 204*b* and the upper heel ball control pad 204*d*. Here, a first end portion of the upper mid-foot ball control pad 204*c* that is adjacent to the upper forefoot ball control pad 204*b* extends along the upper forefoot axis $A_{204b}$, while a second end portion of the upper mid-foot ball control pad 204*c* that is adjacent to upper heel ball control pad 204*d* extends along the upper heel axis $A_{204d}$. The first end portion and the second end portion may be connected by an angled or arcuate intermediate portion of the upper mid-foot ball control pad 204*c*, which defines an angle or curvature $C_{204c}$ of the first path $P_1$. Thus, the first path $P_1$ may be collectively defined by the upper forefoot axis $A_{204b}$, the curvature $C_{204c}$, and the upper heel axis $A_{204d}$.

The lower series of ball control pads 204*e*-204*g* extends along the second path $P_2$ from the forefoot region 12 to the heel region 16. The lower forefoot ball control pad 204*e* and the lower heel ball control pad 204*g* are substantially straight. Accordingly, the lower forefoot ball control pad 204*e* defines a lower forefoot axis $A_{204e}$ extending in the first longitudinal direction and the lower heel ball control pad 204*g* defines a lower heel axis $A_{204g}$ extending in the second longitudinal direction transverse to the first longitudinal direction. The lower mid-foot ball control pad 204*f* may itself be angled or arcuate to provide a transition between the lower forefoot ball control pad 204*e* and the lower heel ball control pad 204*g*. Here, a first end portion of the lower mid-foot ball control pad 204*f* that is adjacent to the lower forefoot ball control pad 204*e* extends along the lower forefoot axis $A_{204e}$, while a second end portion of the lower mid-foot ball control pad 204*f* that is adjacent to lower heel ball control pad 204*g* extends along the lower heel axis $A_{204g}$. The first end portion and the second end portion may be connected by an angled or arcuate intermediate portion of the lower mid-foot ball control pad 204*f*, which defines an angle or curvature $C_{204f}$ of the first path $P_1$. Thus, the second path $P_2$ may be collectively defined by the lower forefoot axis $A_{204e}$, the curvature $C_{204f}$, and the lower heel axis $A_{204g}$.

Each of the ball control pads 204*a*-204*g* includes a ball control panel 206*a*-206*g* attached to and spaced apart from the base panel 202 by one or more flexible elements or posts 208. The ball control panels 206*a*-206*g* each include an interior surface 210*a*-210*g* spaced apart from and facing the base panel 202, an exterior surface 212*a*-212*g* formed on an opposite side from the interior surface 210*a*-210*g*, and a peripheral surface 214*a*-214*g* extending from the interior surface 210*a*-210*g* to the exterior surface 212*a*-212*g*. Here, the exterior surface 212*a*-212*g* of each ball control panel 206*a*-206*g* defines the exterior surface of the respective ball control pad 204*a*-204*g*. Likewise, the peripheral surface 214*a*-214*g* of each ball control panel 206*a*-206*g* defines an outer peripheral profile of the respective ball control pad 204*a*-204*g*.

With reference to FIGS. 4A and 4B, examples of configurations of the ball control pads 204*a*-204*g* are illustrated. The configurations of the ball control pads 204 shown in FIGS. 4A and 4B are labeled with generic reference numerals not including letter suffixes, and can be incorporated into any one or more of the ball control pads 204*a*-204*g*. For example, all of the ball control panels 204*a*-204*g* may be configured according to either one of the examples of FIG. 4A or FIG. 4B. Alternatively, one or more of the ball control pads 204*a*-204*g* may be configured according to the example of FIG. 4A, while one or more of the other ball control pads 204*a*-204*g* may be configured according to the example of FIG. 4B.

With continued reference to FIGS. 4A and 4B, each of the flexible elements 208 includes a resilient element attached to the upper 100 via the base panel 202. As shown, the flexible elements 208 are elongate elements, where a length $L_{208}$ of each of the flexible elements 208 extends from a proximal end 216 attached to the base panel 202 to a distal end 218 attached to the interior surface 210 of the ball control panel 206. Accordingly, the length $L_{208}$ of flexible elements 208 defines a distance between the base panel 202 and the ball control panel 206, and consequently, an overall thickness $T_{204}$ of the ball control pad 204.

Each of the flexible elements 208 is formed of a resilient polymeric material. In the illustrated examples, the flexible elements 208 are shown as cylindrical bodies. However, in other examples, the flexible elements 208 may have polygonal or irregular cross-sectional shapes. Additionally or alternatively, the cross-sectional area of the flexible elements 208 may be varied to tune a stiffness of the ball control pad 204.

The ball control panel 206 be formed as a composite ball control panel 206. In the illustrated example, the ball control panel 206 includes an inner layer 220 and an outer layer 222. The inner layer 220 includes the interior surface 210 of the ball control panel 206, and is attached to the distal ends 218 of the flexible elements 208. The outer layer 222 is disposed on an outward-facing surface of the inner layer 220 and includes the exterior surface 212 of the ball control panel 206.

The inner layer 220 and the outer layer 222 of the ball control panel 204 may be formed of different materials, wherein a first material of the inner layer 220 is selected to provide first desired characteristics to the ball control panel 206, and a second material of the outer layer 222 is selected to provide second desired characteristics to the ball control panel 206. For example, the inner layer 220 may be formed of a first polymeric material configured to provide structural support to the ball control panel 206, while the outer layer 222 is formed of a second polymeric material configured to provide grip to the ball control pad 204. For example, the first material of the inner layer 220 may have a greater hardness than the second material of the outer layer 222. Optionally, the second material of the outer layer 222 has a greater coefficient of friction than the first material of the inner layer 220. In some examples, the outer layer 222 may be applied to the inner layer 220 as a coating of the second material. One example of a suitable material for the outer layer 222 includes a thermoplastic polyurethane (TPU), which provides favorable characteristics related to elasticity, hardness, friction, and abrasion resistance.

In one example (FIG. 4A), the ball control pad 204 may include the ball control panel 206 attached to and spaced apart from the base panel 202 by a plurality of evenly-distributed flexible elements 208. Here, the flexible elements 208 may be arranged in a series of evenly-spaced rows and/or columns to provide a substantially homogenous distribution of the flexible elements 208 between the base panel 202 and the ball control panel 206. Accordingly, the resiliency of the ball control pad 204 will be substantially constant across the entire ball control panel 206.

In another example (FIG. 4B), the ball control pad 204 includes the ball control panel 206 attached to and spaced apart from the base panel 202 by a plurality of variably-distributed flexible elements 208. Here, the flexible elements 208 may be arranged in regions 224, 226 having different concentrations or densities of the flexible elements 208. For example, the flexible elements 208 may be arranged in stiff regions 224 and flex regions 226, where the stiff regions 224 have a greater concentration or density of the flexible elements 208 than the flex regions 226. Put another way, spacing between adjacent flexible elements 208 is less in the stiff regions 224 than in the flex regions 226.

Although the example of the ball control pad 204 in FIG. 4B shows each of the stiff regions 224 having substantially similar concentrations of flexible elements 208, in some examples, the stiff regions 224 may have different concentrations of the flexible elements 208. For example, a first one of the stiff regions 224 may have a first concentration of the flexible elements 208 that is greater than the concentration of flexible elements 208 in the flex regions 226, and a second one of the stiff regions 224 may have a second concentration of the flexible elements 208 that is greater than the first concentration and is greater than the concentration of the flexible elements 208 in the flex regions 226.

Additionally or alternatively, concentrations of the flexible elements 208 may be variable within a single one of the stiff regions 224, whereby a first portion of the stiff region 224 has a first concentration and a second portion of the stiff region 224 has a second concentration. Here, the average concentration of the flexible elements 208 within the stiff region 224 is greater than the average concentration of the flexible elements 208 within the flex region 226.

In some examples, the lengths $L_{208}$ of the flexible elements 208 may be variable such that the thickness $T_{204}$ of one or more of the ball control pads 204*a*-204*g* is different from a thickness $T_{204}$ of one or more of the other ball control pads 204*a*-204*g*. Additionally or alternatively, lengths $L_{208}$ of the flexible elements 208 may vary within a single one of the ball control pads 204*a*-204*g*. Particularly, one or more of the ball control pads 204*a*-204*g* may be provided with longer flexible elements 208 in areas where more impact attenuation is desired, and with shorter flexible elements 208 in areas where a stiffer ball control region 200 is desired. For example, in FIG. 3, the thickness $T_{204}$ of the upper mid-foot ball control pad 204*c* tapers along a direction from the central peripheral region 22 to the dorsal region 18. Similarly, the thickness $T_{204}$ of the lower mid-foot ball control pad 204*f* tapers along a direction from the central peripheral region 22 to the plantar region 20. The other ball control panels 204*a*, 204*b*, 204*d*, 204*e*, 204*g* may be similarly tapered. Alternatively, one or more of the ball control panels 204*a*-204*g* may have a constant thickness $T_{204}$.

As provided above, characteristics of each of the ball control pads 204*a*-204*g* may be modified to tune the responsiveness of the ball control pads 204*a*-204*g*. For example, the flexible elements 208 may be provided in different sizes and shapes, and/or may be provided in different arrangements to increase or decrease stiffness of the ball control pads 204*a*-204*g*. Additionally or alternatively, material properties and dimensions of the inner layer 220 and outer layer 222 of the ball control panels 206*a*-206*g* may be selected to form harder or softer ball control panels 206*a*-206*g*.

Figure 5A:
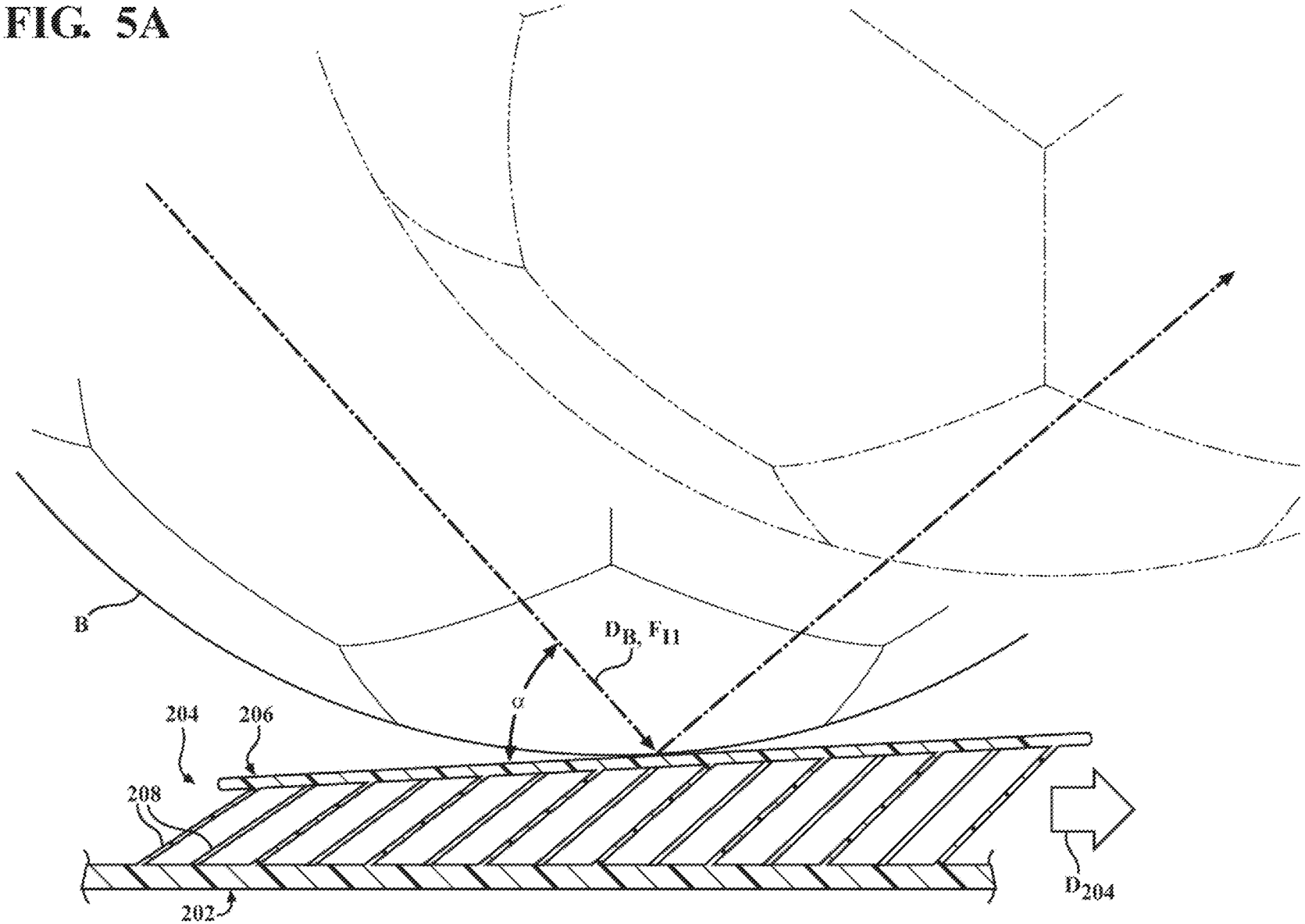
FIG. 5A is an environmental view showing a response of the ball control pad of FIG. 4A under the effects of an impact force.

With reference to FIG. 5A, an example illustrating responsiveness of a ball control pad 204 is illustrated, where the ball control pad 204 is formed with a constant concentration of the flexible elements 208. Here, the ball B is received by the exterior surface 212 of the ball control panel 206 from a first direction $D_B$ at an angle $\alpha$ and exerts an impact force $F_{11}$ on the exterior surface 212. As shown, the angle $\alpha$ is an oblique angle such that the impact force $F_{11}$ includes a compressive component extending perpendicular to the exterior surface 212 and a shear component extending parallel to the exterior surface 212. The compressive component of the impact force $F_{11}$ causes the ball control pad 204 to depress, whereby the distance between the ball control panel 206 and the base panel 202 is decreased. Simultaneously, the shear component causes the ball control panel 206 to shift laterally in a direction $D_{204}$ relative to the base panel 202. Accordingly, the ball control pad 204 acts to receive the ball and to attenuate the impact force $F_{11}$. Additionally, by moving with the ball B, the ball control panel 206 maintains contact with the ball B for a greater duration, thereby providing the wearer with a greater amount of time to provide influence to the outgoing trajectory and rotation of the ball B.

Figure 5B:
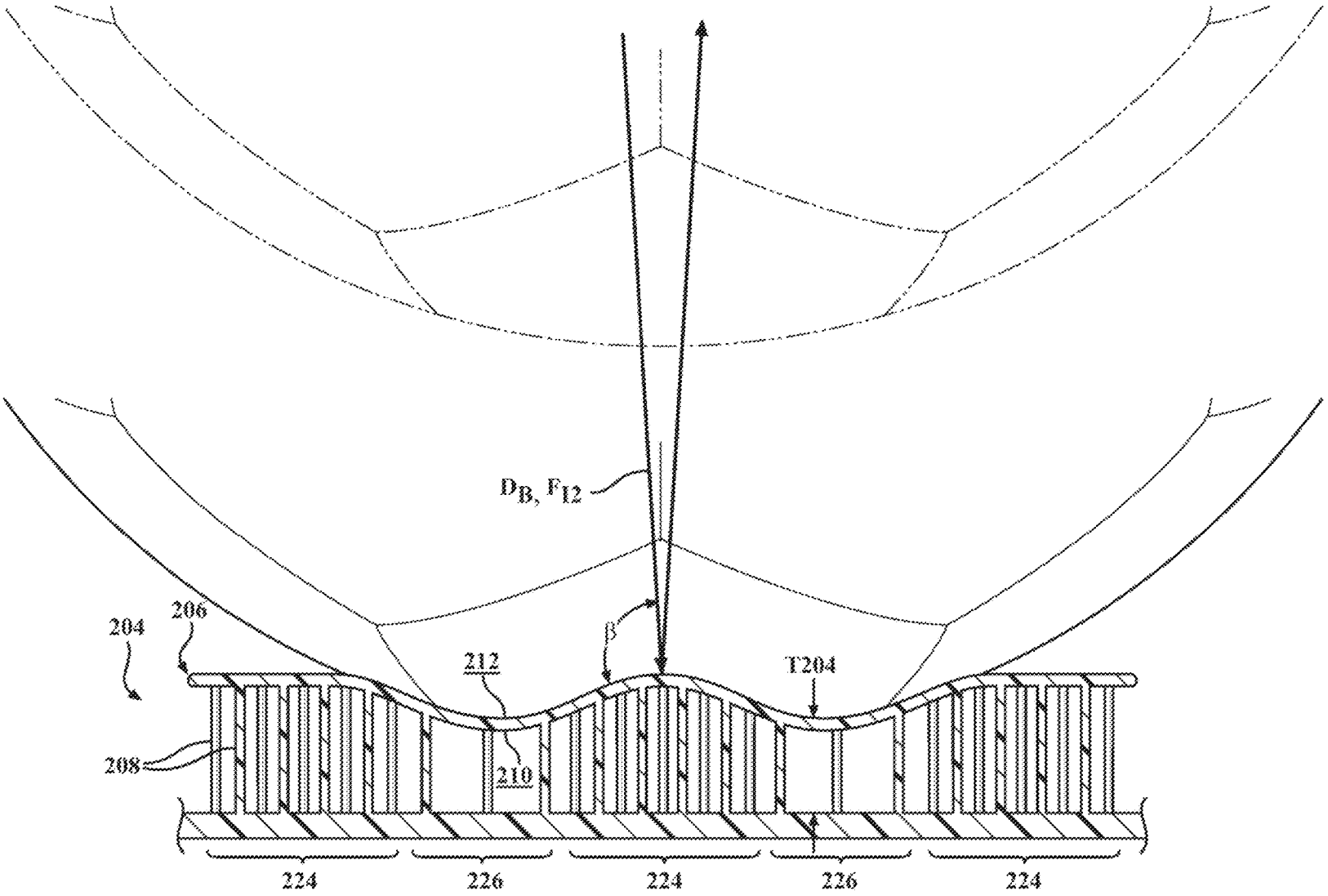
FIG. 5B is an environmental view showing a response of the ball control pad of FIG. 4B under the effects of an impact force.

In another example, illustrated in FIG. 5B, responsiveness of a ball control pad 204 is shown where the ball control pad 204 is formed with stiff regions 224 and flex regions 226, as described above. Here, the ball B is received by the exterior surface 212 of the ball control panel 206 at an angle $\beta$ and exerts a compound impact force $F_{12}$ having a compressive component and a shear component. In this example, the compressive component is greater than the shear component, whereby the relative angle $\beta$ between the trajectory of the ball B and the exterior surface 212 is greater than in the example of FIG. 5A.

Unlike the example of FIG. 5A, where the entire ball control panel 206 is compressed in a substantially uniform manner, in the example of FIG. 5B, the ball control panel 206 compresses in a non-uniform manner. Particularly, the ball control panel 206 deflects at a greater rate in the flex regions 226 than in the stiff regions 224. Accordingly, when the ball B impacts the ball control panel 206, the ball control panel 206 will compress at the flex regions 226 to absorb a portion of the impact force $F_{12}$. Simultaneously, as the ball control panel 206 compresses in the flex regions 226, the portions of the ball control panel 206 supported by the flexible elements 208 in the stiff regions 224 will remain extended relative to the flex regions 226, thereby forming stiff peaks that protrude into and engage the ball B.

By configuring the ball control pad 204 as discussed above (i.e., modifying the flexible elements 208 or the ball control panel 206), the responsiveness of the ball control pad 204 can be tuned to provide a desired combination of impact attenuation and grip. For example, the ball control pads 204*a*-204*g* can each be individually configured based on a desired performance characteristic. For example, ball control pads 204*a*-204*g* located in one portion of the ball control region 200 may have characteristics more suitable for attenuating compressive impacts (e.g. kicking), while ball control pads 204*a*-204*g* located in another portion of the ball control region 200 may have characteristics more suitable for attenuating shear impacts (e.g., passing).

The following Clauses provide an exemplary configuration for an article of footwear described above.

Clause 1: An article of footwear comprising an upper and a ball control region formed on an exterior surface of the upper and including at least one ball control pad having a ball control panel attached to and spaced apart from the upper by one or more flexible elements.

Clause 2: The article of footwear of Clause 1, wherein the at least one ball control pad includes a first ball control pad attached to a first portion of the upper and a second ball control pad attached to a second portion of the upper independently from the first ball control pad.

Clause 3: The article of footwear of Clause 1, wherein each of the one or more flexible elements is a resilient element having a first end attached to the upper and a second end attached to the ball control panel.

Clause 4: The article of footwear of Clause 1, wherein the ball control panel includes a first layer formed of a first material and a second layer formed of a second material.

Clause 5: The article of footwear of Clause 4, wherein the first layer is attached to the flexible elements and the first material has a hardness greater than the second material.

Clause 6: The article of footwear of Clause 4, wherein the second layer forms an exterior surface of the ball control panel and the second material has a coefficient of friction greater than the first material.

Clause 7: The article of footwear of Clause 1, wherein the at least one ball control pad includes a first series of ball control pads extending from a toe region to a heel region and a second series of ball control pads extending from a mid-foot region to the heel region.

Clause 8: The article of footwear of Clause 7, wherein the first series of ball control pads is disposed above the second series of ball control pads.

Clause 9: The article of footwear of Clause 1, wherein a stiffness of the at least one ball control pad varies from a first portion of the ball control pad to a second portion of the ball control pad.

Clause 10: The article of footwear of Clause 1, wherein a concentration of the flexible elements of the at least one ball control pad varies from a first portion of the ball control pad to second portion of the ball control pad.

Clause 11: The article of footwear of Clause 1, wherein a thickness of the at least one ball control pad varies from a first portion of the ball control pad to a second portion of the ball control pad.

Clause 12: The article of footwear of Clause 1, wherein the at least one ball control pad includes a first ball control pad having a first stiffness and a second ball control pad having a second stiffness that is different from the first stiffness.

Clause 13: An article of footwear comprising an upper and a ball control region formed on an exterior surface of the upper and including a plurality of ball control pads each having a ball control panel spaced apart from and resiliently attached to the exterior surface of the upper.

Clause 14: The article of footwear of Clause 13, wherein each of the ball control pads is attached to the exterior surface of the upper by a plurality of flexible elements.

Clause 15: The article of footwear of Clause 14, wherein a first one of the ball control pads includes a first panel attached to the upper by a first plurality of flexible elements and a second one of the ball control pads includes a second panel attached to the upper by a second plurality of flexible elements, the first plurality of flexible elements having a different concentration of flexible elements than the second plurality of flexible elements.

Clause 16: The article of footwear of Clause 14, wherein each of the plurality of the flexible elements is a resilient element having a first end attached to the upper and a second end attached to the ball control panel.

Clause 17: The article of footwear of Clause 13, wherein the ball control panel includes a first layer formed of a first material and a second layer formed of a second material.

Clause 18: The article of footwear of Clause 17, wherein the first layer is attached to the upper and the first material has a hardness greater than the second material.

Clause 19: The article of footwear of Clause 17, wherein the second layer forms an exterior surface of the ball control panel and the second material has a coefficient of friction greater than the first material.

Clause 20: The article of footwear of Clause 13, wherein the plurality of ball control pads includes a first series of ball control pads extending from a toe region to a heel region and a second series of ball control pads extending from a mid-foot region to the heel region.

Clause 21: The article of footwear of Clause 20, wherein the first series of ball control pads is disposed above the second series of ball control pads.

Clause 22: The article of footwear of Clause 13, wherein a first stiffness of a first one of the ball control pads is different from a second stiffness of a second one of the ball control pads.

Clause 23: The article of footwear of Clause 13, wherein a first thickness of a first one of the ball control pads is different from a second thickness of a second one of the ball control pads.

Clause 24: The article of footwear of Clause 13, wherein at least one of the plurality of ball control pads tapers from a first thickness to a second thickness.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. An article of footwear comprising:

an upper; and a ball control region formed on an exterior surface of the upper extending from a plantar region to a dorsal region including;

a base panel extending along the ball control region, the base panel further extending from the plantar region through the dorsal region, and the base panel extending from a medial region to a lateral region; and at least one ball control pad having a ball control panel attached to and spaced apart from the base panel by one or more flexible elements.

2. The article of footwear of claim 1, wherein the at least one ball control pad includes a first ball control pad attached to a first portion of the upper and a second ball control pad attached to a second portion of the upper independently from the first ball control pad.

3. The article of footwear of claim 1, wherein each of the one or more flexible elements is a resilient element having a first end attached to the upper and a second end attached to the ball control panel.

4. The article of footwear of claim 1, wherein the ball control panel includes a first layer formed of a first material and a second layer formed of a second material, wherein the first layer is attached to the flexible elements and the first material has a hardness greater than the second material and the second layer forms an exterior surface of the ball control panel and the second material has a coefficient of friction greater than the first material.

5. The article of footwear of claim 1, wherein the at least one ball control pad includes a first series of ball control pads extending from a toe region to a heel region and a second series of ball control pads extending from a mid-foot region to the heel region, wherein the first series of ball control pads is disposed above the second series of ball control pads.

6. The article of footwear of claim 1, wherein a stiffness of the at least one ball control pad varies from a first portion of the ball control pad to a second portion of the ball control pad.

7. The article of footwear of claim 1, wherein a concentration of the flexible elements of the at least one ball control pad varies from a first portion of the ball control pad to second portion of the ball control pad.

8. The article of footwear of claim 1, wherein a thickness of the at least one ball control pad varies from a first portion of the ball control pad to a second portion of the ball control pad.

9. The article of footwear of claim 1, wherein the at least one ball control pad includes a first ball control pad having a first stiffness and a second ball control pad having a second stiffness that is different from the first stiffness.

10. The article of footwear of claim 5, wherein the second series of ball control pads extend into the plantar region.

11. The article of footwear of claim 1, wherein a portion of the base panel that is free of the at least one ball control pad extends into a lateral side of the upper.

12. The article of footwear of claim 1, wherein the ball control region is disposed solely on a medial side of the article of footwear.

13. An article of footwear comprising:

an upper; and a ball control region formed on an exterior surface of the upper extending from a dorsal region to a plantar region and including a plurality of ball control pads each having a ball control panel spaced apart from and resiliently attached to the exterior surface of the upper, wherein a portion of the ball control region, a portion of each of the plurality of ball control pads, and a portion of each of the ball control panels extend into the plantar region.

14. The article of footwear of claim 13, wherein each of the ball control pads is attached to the exterior surface of the upper by a plurality of flexible elements, and wherein a first one of the ball control pads includes a first panel attached to the upper by a first plurality of flexible elements and a second one of the ball control pads includes a second panel attached to the upper by a second plurality of flexible elements, the first plurality of flexible elements having a different concentration of flexible elements than the second plurality of flexible elements, and wherein each of the plurality of the flexible elements is a resilient element having a first end attached to the upper and a second end attached to the ball control panel.

15. The article of footwear of claim 13, wherein the ball control panel includes a first layer formed of a first material and a second layer formed of a second material, and wherein the first layer is attached to the upper and has a hardness greater than the second material and the second layer forms an exterior surface of the ball control panel and has a coefficient of friction greater than the first material.

16. The article of footwear of claim 13, wherein (i) a first stiffness of a first one of the ball control pads is different from a second stiffness of a second one of the ball control pads, (ii) a first thickness of a first one of the ball control pads is different from a second thickness of a second one of the ball control pads, or (iii) at least one of the plurality of ball control pads tapers from a first thickness to a second thickness.

17. An article of footwear comprising:

an upper;

a sole structure attached to a bottom surface of the upper; and a ball control region coupled to an exterior surface of the upper, wherein the ball control region includes a plurality of ball control pads each having a ball control panel, each ball control panel spaced apart from and attached to a base panel by one or more flexible elements, wherein the plurality of ball control pads of the ball control region are disposed solely on a medial side of the article of footwear, and wherein an entirety of an exterior surface of a lateral side of the article of footwear comprises only 1) an exterior surface of the upper, 2) the sole structure, and 3) the base panel.

18. The article of footwear of claim 17, wherein each ball control pad of the plurality of ball control pads is independently attached to the base panel.

19. The article of footwear of claim 17, wherein the ball control panel includes a first layer including a first material and a second layer including a second material, the first material having a hardness that is greater than a hardness of the second material, and the second material having a greater coefficient of friction than a coefficient of friction of the first material.

20. The article of footwear of claim 17, wherein the plurality of ball control pads includes a first series of ball control pads and a second series of ball control pads, and wherein the first series of ball control pads is vertically spaced apart from the second series of ball control pads such that a portion of the base panel is exposed between the first series of ball control pads and the second series of ball control pads.

* * * * *